United States Patent [19]

Lu

[11] Patent Number: 4,830,404

[45] Date of Patent: May 16, 1989

[54] SCREEN-LIKE PHOTO ALBUM

[76] Inventor: Tsann T. Lu, No. 49, Hsin Le Road, An Ping Industrial District, Tainan, China

[21] Appl. No.: 59,256

[22] Filed: Jun. 5, 1987

[51] Int. Cl.[4] ..... B42D 1/00; B42D 3/00; B42D 15/00; G09F 1/12

[52] U.S. Cl. ..... 281/2; 281/29; 283/62; 40/152

[58] Field of Search ..... 281/2, 5, 29; 282/11.5 R; 283/62; 40/152, 158 R, 159, 611

[56] References Cited

U.S. PATENT DOCUMENTS

| | | | |
|---|---|---|---|
| 1,550,211 | 8/1928 | Euwer | 283/62 |
| 4,187,630 | 2/1980 | Giulie et al. | 40/152 |
| 4,451,998 | 6/1984 | Philipp | 40/152 |
| 4,569,613 | 2/1986 | Thomas | 281/45 |
| 4,586,729 | 5/1986 | Beylerian | 281/2 |
| 4,679,341 | 7/1987 | Goldman | 40/152 |

FOREIGN PATENT DOCUMENTS

| | | | |
|---|---|---|---|
| 2641308 | 12/1977 | Fed. Rep. of Germany | 281/2 |
| 889002 | 12/1943 | France | 281/2 |
| 1486575 | 6/1967 | France | 281/29 |

*Primary Examiner*—Frank T. Yost
*Assistant Examiner*—Paul M. Heyrana, Sr.
*Attorney, Agent, or Firm*—Lowe, Price, LeBlanc, Becker & Shur

[57] ABSTRACT

This invention relates to a screen-like photo album constituted by linking adjacent edges of each page in sequence to form a belt-like structure, placing its first page and last page inside with respect to a hard front cover and hard back cover, and edging the top and the bottom edges of each but the first and last pages by metal clips to form a double duty photo album which will be in the form of a file when closed or in the form of a screen when the linked pages of the photo album are opened.

4 Claims, 4 Drawing Sheets

SCREEN-LIKE PHOTO ALBUM

BACKGROUND OF THE INVENTION

This invention relates to a screen-like photo ablum, particular to one linking the edges of each page in sequence, and placing its first and last pages between a hard front cover and hard back cover, to form a file-like or screen-like photo album to satisfy different purposes.

Heretofore, many photo albums have been produced and sold on the market. They are traditionally formed as a file, that is, only for collecting photographs. However, collecting photographs systematically is often necessary for different topics, such as marriage or travelling. Traditional photo albums cannot emphasize the series of each topic and do not let a number of people look at the photographs at the same time. If each page of a traditional album is framed and shown individually, it would be very complicated and expensive.

SUMMARY OF THE INVENTION

It is the primary object of the present invention to provide a way to solve the above problems by linking the edges of each page in sequence, spreading the pages to form a screen-like decoration and to satisty both collecting and decorating purposes. When this photo album is closed, it will be in the form of a simple photo album.

Therefore, the principal object of the present invention is to provide a double duty photo album to satisfy decorating when spread as a screen or, in the alternative, allowing turning of its pages to form a simple photo album.

DETAILED DESCRIPTION OF THE PREFERRED EMBODIMENT

Figure 1:
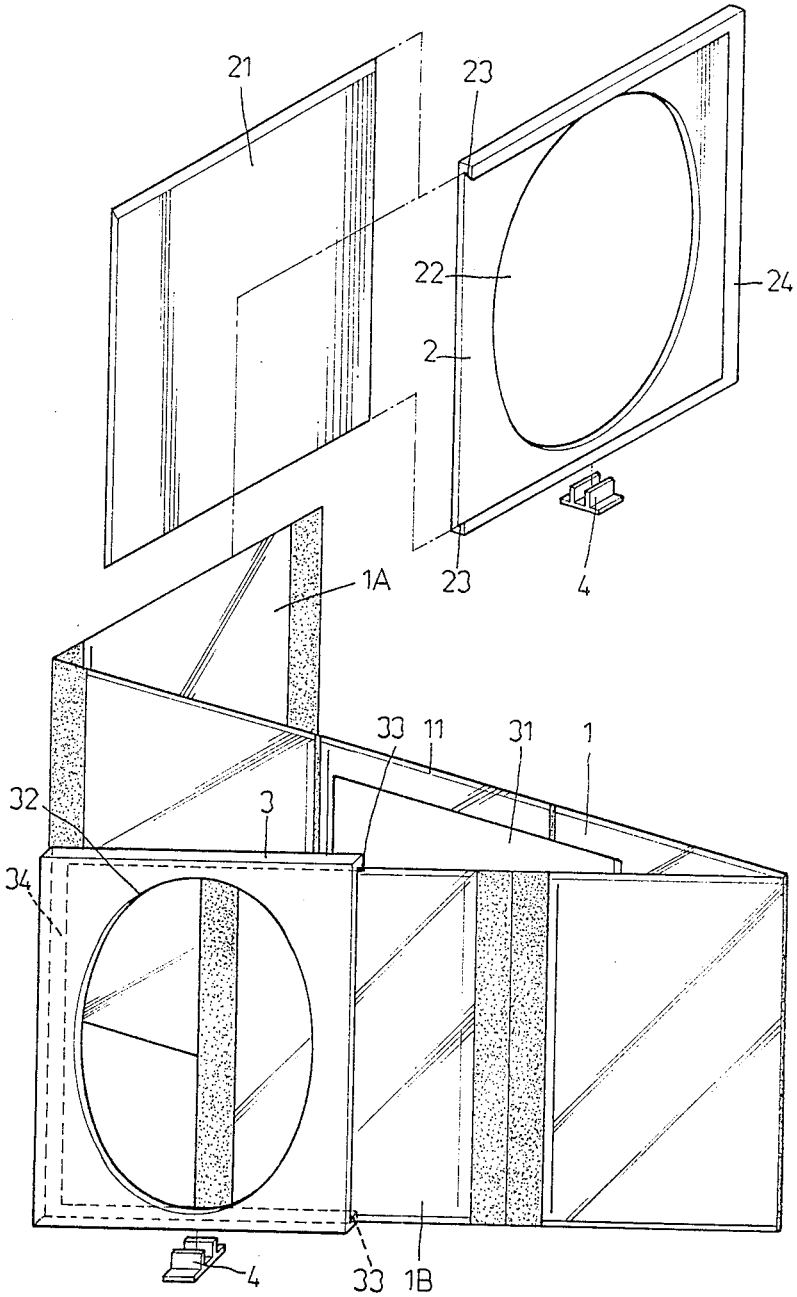
FIG. 1 is an exploded view of the present invention.

With reference to FIG. 1, the adjacent edges of all internal pages 1 are linked together to form a belt-like form. Transparent plastic membranes with an opening to one edge of each page are provided on each page for the entrance of photographs thereby. Every page except the first and last has its top edge and bottom edge (the two narrow edges) edged with metal clips 11 so that the pages are beautified and framed to prevent their being bent.

The designs of the front and back covers are similar, and each is composed of a front (back) cover and a sliding board. An elliptical hole (or a hole of other geometrical shape) is made on the front (back) cover and two sliding channels 23 and (33) and one stoping edge 24(34) are attached at the internal edges of the cover for sliding the first (last) page 1A (1B) with photographs mounted to the first and last of internal page 1 into the inner side of the front (back) cover 2(3) to make the photographs stay in correspondence with the elliptical hole. When a sliding board 21(31) is tightly slid, into the sliding channels 23(33) and stops at stopping edge 24(34), the first and last pages 1A and 1B of the internal page 1 are fixed inside the covers by the sliding board 21(31) sliding respectively into the front and back cover of the photo album to form a complete booklet. In addition, in order to make the screen stand firmly when opened out, an inverted doubletshaped plate 4 is placed at the bottom of each of the two covers to prevent the album being when tipped over.

Figure 2:
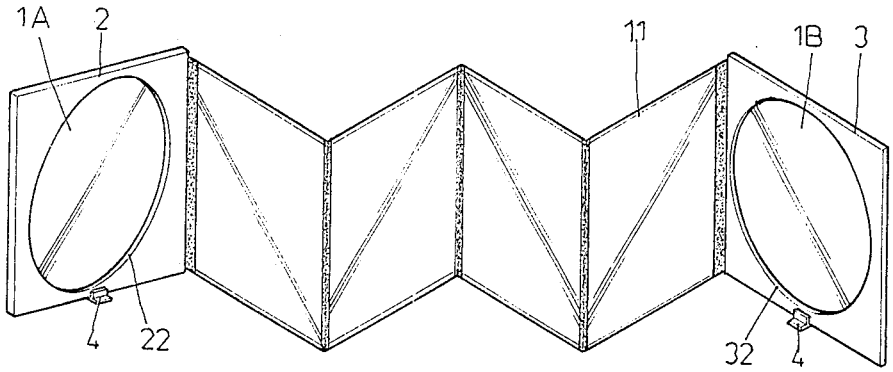
FIG. 2 is a perspective view of the present invention when spreading as a screen.
Figure 3:
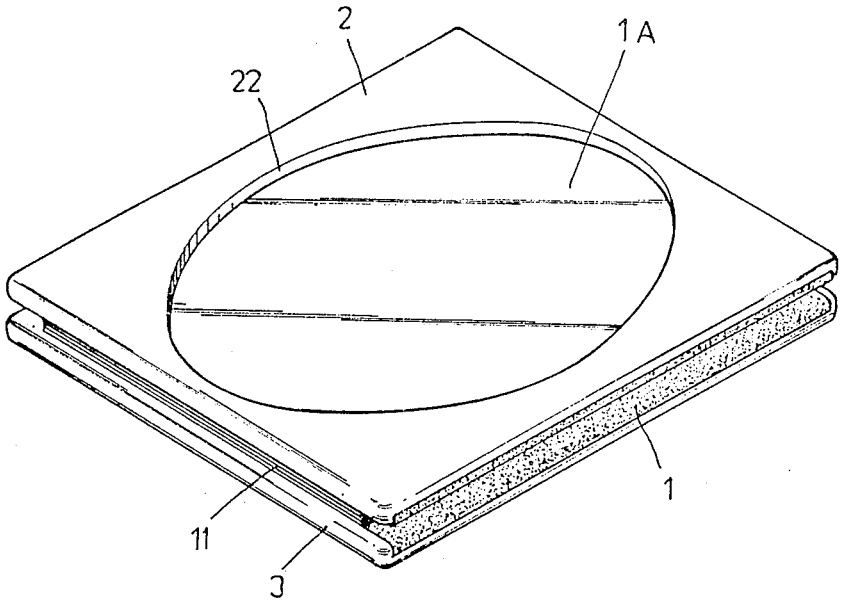
FIG. 3 is a sectional view of a cover.
Figure 4:
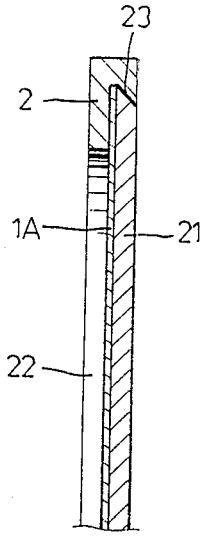
FIG. 4 is a perspective view of the present invention when closed as a file.

In practice, when the owner of the photo album collects a group of photographs of related activities in one album and places the most memorable or creative photographs at the front and back covers of the album, it provides an easy understanding of the contents of the album and user satisfaction that the covers are designed by himself. Furthermore, except that the album can be closed as a file (see FIG. 2), the characteristics of being a screen-like album when all pages are spread open due to the special design of metal edge 11 and auxiliary plate 4, means that all photographs can be shown at the same time to meet a decorating purpose. The photographs in of the photo album can be changed after a certain period of time and can give a fresh feeling and a variable decoration. For those merchants who mainly sell photographs of movie stars or scenery, the present invention is an optimum album because it can show all photographs at one time when spreadout as a screen yet and decrease its size when closed.

In conclusion, the present invention has the following advantages;

1. Besides being usable as a file-like album, it can be spreadopen as a screen to show a series of photographs to satisfy a variable life style.

2. The photographs of the front and back covers are selected by the owner to provide easy understanding of the contents to and satisfy his creative desires.

3. Metal edges at the top and bottom edges of the inner pages and the front and back covers beautify the album and simplify the turning of each page of the album.

I claim:

1. A screen-like photo album, constituted by linking adjacent edges of each page in sequence to form a belt-like structure, comprises:

a front cover and a back cover made of hard board each provided with geometric holes;

sliding boards;

two pairs of sliding channels connected respectively to top and bottom edges of the front and back covers; and a stopping edge connected to a vertical edge of each cover for slidingly receiving a sliding board therein, with the first and last pages held firmly between the respective front and back covers and sliding boards by the channels and the stopping edge thereat to form a file-like album when opened and a screen-like album when closed.

2. A screen-like album according to claim 1, further comprising:

metal clips connected at the top and bottom edges of all the internal pages except the first and the last pages.

3. A screen-like album according to claim 1, further comprising:

support means connectable to the bottom edges of the front and back covers for supporting the album in spread out form on a support surface for easy viewing of the pages.

4. A screen-like album according to claim 2, further comprising:

support means connectable to the bottom edges of the front and back covers for supporting the album in spread out form on a support surface for easy viewing of the pages.

* * * * *